US007374398B2

(12) United States Patent
Marchese et al.

(10) Patent No.: US 7,374,398 B2
(45) Date of Patent: May 20, 2008

(54) AUTOMOTIVE COMPRESSOR

(75) Inventors: Paolo Marchese, Orbassano (IT); Fabio Pesola, Orbassano (IT); Dario Caenazzo, Orbassano (IT); Paolo Delzanno, Orbassano (IT)

(73) Assignee: C.R.F. Societá Consortile per Azioni, Orbassano (IT)

( * ) Notice: Subject to any disclaimer, the term of this patent is extended or adjusted under 35 U.S.C. 154(b) by 2 days.

(21) Appl. No.: 11/117,710

(22) Filed: Apr. 29, 2005

(65) Prior Publication Data

US 2005/0260068 A1 Nov. 24, 2005

(30) Foreign Application Priority Data

May 18, 2004 (EP) ..... 04425351

(51) Int. Cl.
*F04D 29/44* (2006.01)
*F04D 29/46* (2006.01)

(52) U.S. Cl. ..... 415/189; 415/209.2; 415/210.1; 415/214.1; 415/224.5; 415/912

(58) Field of Classification Search ..... 415/189, 415/190, 191, 208.2, 209.2, 209.3, 209.4, 415/210.1, 912, 208.3, 208.4, 211.1, 214.1, 415/224.5; 29/889.22
See application file for complete search history.

(56) References Cited

U.S. PATENT DOCUMENTS 1,931,692 A * 10/1933 Good ..... 415/191
2,453,524 A * 11/1948 McMahan et al. ..... 415/191
2,628,768 A * 2/1953 Kantrowitz ..... 415/191
2,672,281 A * 3/1954 Redding ..... 415/191
3,039,675 A * 6/1962 Reichner ..... 415/191
3,846,039 A * 11/1974 Stalker ..... 415/208.2
4,249,859 A * 2/1981 Benyi et al. ..... 415/189
4,470,256 A 9/1984 Palmer
4,676,717 A * 6/1987 Willyard et al. ..... 415/912
4,695,225 A * 9/1987 Hellat et al. ..... 415/189
5,076,758 A * 12/1991 Palgrave ..... 415/912
5,460,484 A 10/1995 Yagi
5,758,500 A * 6/1998 Sumser et al. ..... 415/158

FOREIGN PATENT DOCUMENTS

GB 604121 A * 6/1948 ..... 415/210.1
JP 56-524 A 1/1981
JP 61-79900 A * 4/1986 ..... 415/224.5
JP 2002-122097 A 4/2002

* cited by examiner

*Primary Examiner*—Christopher Verdier
(74) *Attorney, Agent, or Firm*—Venable LLP; Robert Kinberg; Steven J. Schwarz

(57) ABSTRACT

An automotive compressor is provided having a casing defining an intake section for fluid for compression, and a delivery section for delivering the compressed fluid. An impeller is movable angularly inside the casing to increase the pressure of the fluid. A distributor is carried by the intake section of the casing to conduct the fluid for compression to the impeller. The casing and the distributor are defined by separate members connected releasably to each other.

6 Claims, 2 Drawing Sheets

AUTOMOTIVE COMPRESSOR

CROSS-REFERENCE TO RELATED APPLICATION

This application claims the priority of European Patent Application No. 04425351.6, filed on May 18, 2004, the subject matter of which is incorporated herein by reference.

BACKGROUND OF THE INVENTION

The present invention relates to an automotive compressor, in particular for supplying pressurized fluid to fuel cell systems.

Automotive centrifugal compressors are known which substantially comprise a fixed portion, and one or more bladed impellers driven by an external motor. The fixed portion is normally defined by a hollow casing, in which the impeller rotates to produce the desired compression of the fluid flowing through it.

More specifically, the casing defines, integrally, an intake section through which the fluid to be compressed is fed to the impeller to increase its kinetic energy; and a delivery section defined by a diffuser, in which the kinetic energy is converted to pressure energy.

The intake section may have a number of fixed blades acting as a distributor, i.e. defining respective channels of given shape to conduct and accelerate the fluid intake onto the impeller in the desired direction of impact on the impeller blades.

In other words, the fixed blades substantially provide for imparting to the fluid for compression an optimum direction of impact on the movable blades of the impeller, so as to reduce fluid-dynamic losses and improve the overall efficiency of the compressor.

Fuel cell drive systems require compressor impellers of variable geometry, both for test purposes and to permit a certain amount of flexibility in the equipping of different types of vehicles.

SUMMARY OF THE INVENTION

It is an object of the present invention to provide an automotive compressor designed to permit such flexibility in a straightforward, low-cost manner.

According to the present invention, there is provided an automotive compressor comprising: a casing defining an intake section for a fluid for compression, and a delivery section for delivering the compressed fluid; an impeller movable angularly inside said casing to increase the pressure of said fluid; and a distributor carried by said intake section of said casing to conduct the fluid for compression to said impeller; wherein said casing and said distributor are defined by separate members connected releasably to each other.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
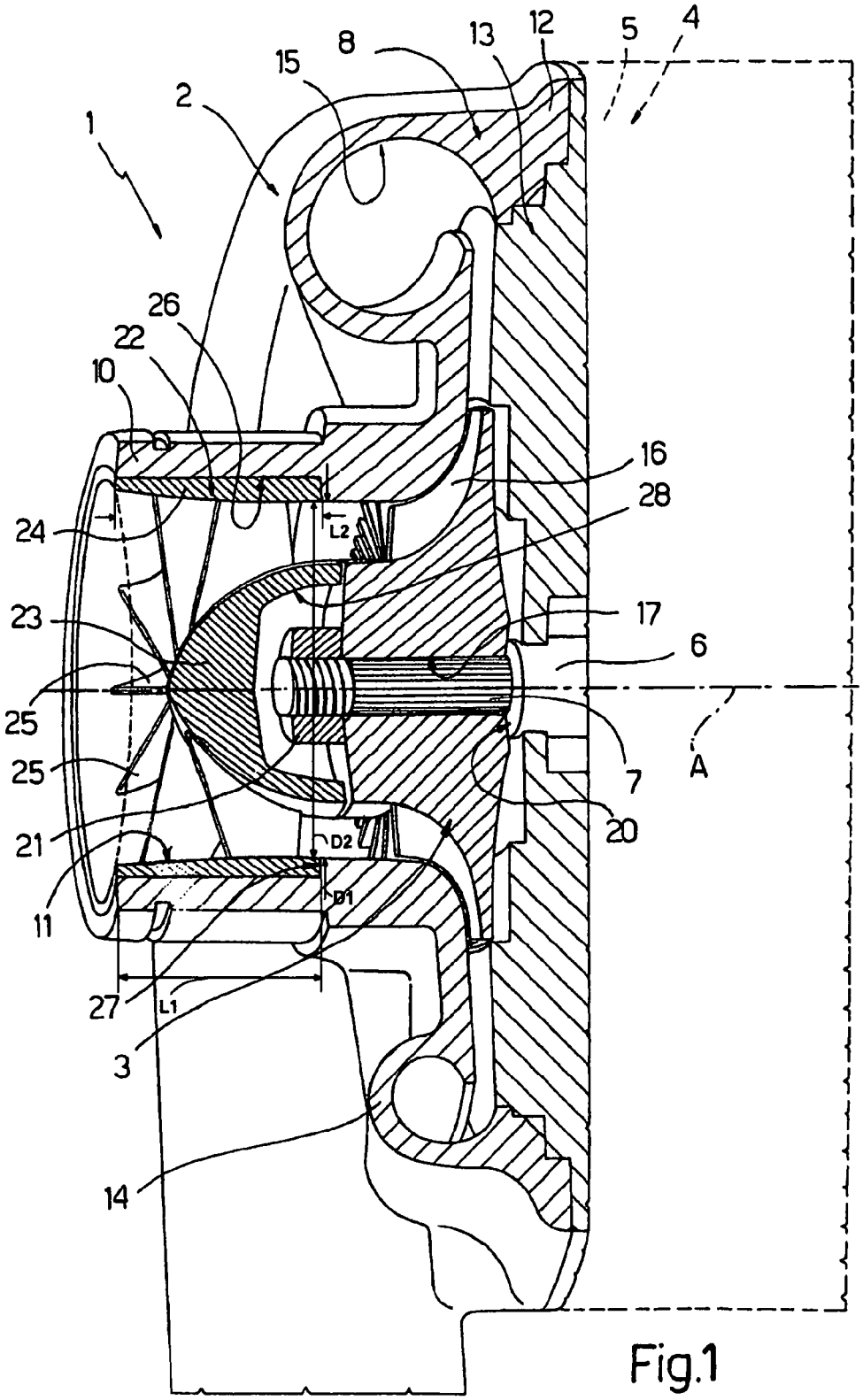
FIG. 1 shows a partly sectioned view in perspective of a compressor in accordance with the present invention.
Figure 2:
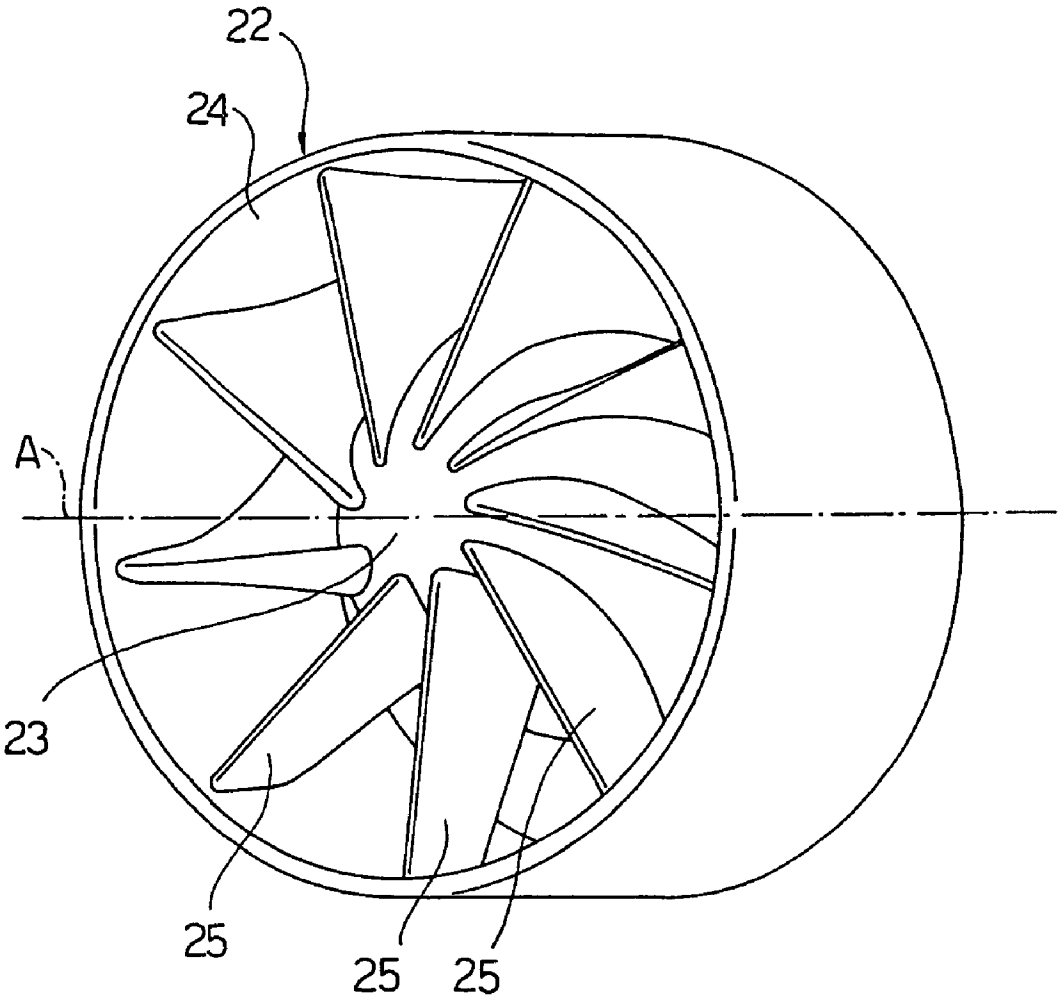
FIG. 2 shows a view in perspective, with parts removed for clarity, of a detail of the FIG. 1 compressor.

With reference to FIGS. 1 and 2, number 1 indicates as a whole a compressor, of axis A, substantially comprising a fixed portion 2, and an impeller 3 housed inside fixed portion 2 and rotated about axis A by a known drive system 4 (shown only partly in FIG. 1) to increase the pressure of the fluid flowing through compressor 1.

In the following disclosure, drive system 4 is described only as required for a clear understanding of the present invention. More specifically, of drive system 4, FIG. 1 shows only a housing 5, and an output shaft 6 having an end portion 7 outside housing 5 and connected to impeller 3 as decribed in detail below.

Fixed portion 2 substantially comprises a casing 8 defining a through axial cavity housing impeller 3.

Casing 8 comprises a minimum-diameter axial end portion 10 defining an intake section 11 for the fluid for compression; a maximum-diameter opposite axial end portion 12 fixed in conventional manner, e.g. by screws not shown, to a flange 13 integral with housing 5 of drive system 4; and an intermediate portion 14 connecting axial end portions 10 and 12, and defining a screw diffuser 15 extending circumferentially with respect to axis A to deliver the compressed fluid.

Impeller 3 is housed substantially in intermediate portion 14 of casing 8, is fitted to portion 7 of shaft 6 of drive system 4 projecting from housing 5, and comprises a number of substantially radial blades 16 equally spaced about axis A. According to the exemplary embodiment shown in FIG. 1, casing 8 can comprise a one-piece fixed casing. Also shown in the exemplary embodiment of FIG. 1, casing 8 can be substantially coaxial with the output shaft 6.

More specifically, impeller 3 has a through axial hole 17 engaged by portion 7 of shaft 6 of drive system 4, and is gripped axially between a shoulder 20 of portion 7, adjacent to drive system 4, and a nut 21 screwed to a threaded free end of portion 7.

When tightened, nut 21 makes impeller 3 integral both axially and angularly with portion 7 of shaft 6 of drive system 4; and impeller 3 is removed by simply unscrewing nut 21 completely and withdrawing impeller 3 axially off portion 7 of shaft 6.

An important aspect of the present invention is that fixed portion 2 of compressor 1 also comprises a distributor 22 formed separately from and fitted releasably to casing 8.

Distributor 22 provides for conducting and accelerating the fluid for compression towards impeller 3, and substantially comprises a shaped central portion 23; an outer tubular portion 24 surrounding and spaced radially apart from central portion 23; and a number of blades 25 radiating generally between central portion 23 and tubular portion 24.

Distributor 22 is housed inside a cylindrical seat 26 formed in axial end portion 10 of casing 8. More specifically, seat 26 is bounded towards impeller 3 by an annular shoulder 27 defining an axial stop for tubular portion 24 of distributor 22. In the example shown, distributor 22 is housed interferentially inside seat 26 of casing 8, though other releasable retaining systems may obviously be used.

As shown in FIG. 1, the cylindrical seat 26 can define a first length L1 along its axis, and the tubular portion 24 of the distributor 22 can define a second length L2 that is substantially equal to the first length L1. As also shown, the annular shoulder 27 of the seat 26 can define a first inner diameter D1, and the tubular portion 24 can define a second inner diameter D2 that is substantially equal to the first inner diameter D1. As a result, there can be a flush interface between the tubular portion 24 and the intermediate portion 14 in the region of the annular shoulder 27.

Blades 25 define a number of conducting channels for imparting to the flow entering compressor 1 an appropriate direction with respect to blades 16 of impeller 3.

Central portion 23 is advantageously ogival, increasing in diameter towards impeller 3, so as to gradually reduce the section of the various channels defined by blades 25 in the flow direction.

Central portion 23 also comprises, on the side facing impeller 3, an axial cavity 28 loosely housing the free end of portion 7 of shaft 6 and relative nut 21.

The advantages of compressor 1 according to the present invention will be clear from the foregoing description.

In particular, impellers 3 of different designs can be used on the same compressor 1, and operation of the compressor within a given flow range can be optimized with no need to replace the whole of fixed portion 2, but simply by using different distributors 22 suited to different impellers 3, i.e. having a geometry of fixed blades 25 suited to that of movable blades 16 to minimize fluid-dynamic losses.

Distributor 22 may be produced using methods and materials best suited to the operating conditions and function involved.

Fixed blades 25 of distributor 22 also support ogival central portion 23 to improve fluid-dynamic performance as a whole.

A highly flexible compressor 1 for different types of applications and vehicles is thus obtained relatively simply, with no reduction in efficiency. On the contrary, operation of compressor 1 is optimized using different impellers 3.

Clearly, changes may be made to compressor 1 as described and illustrated herein without, however, departing from the scope of the accompanying claims.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An automotive centrifugal compressor for supplying a compressed fluid, comprising:

a drive system comprising:

a rotatable output shaft having a threaded end; and a housing having an outer flange;

a one-piece fixed casing comprising a first axial end portion secured to the flange, a second axial end portion defining an intake section for fluid, and an intermediate portion connecting the first axial end portion and the second axial end portion, wherein the first axial end portion defines a maximum diameter of the casing, the second axial end portion defines a minimum diameter of the casing, and the intermediate portion defines a circumferential screw diffuser for delivery of the compressed fluid, further wherein the casing is substantially coaxial with the rotatable output shaft;

an impeller secured to the rotatable output shaft by a nut threaded onto the threaded end, the impeller comprising a plurality of substantially radially-oriented blades;

a cylindrical seat formed in the second axial end portion of the casing, the cylindrical seat defining an annular shoulder defining an axial stop; and a distributor comprising a ring-shaped outer portion, an ogival-shaped center portion, and a plurality of fixed blades extending between the outer portion and the center portion, wherein the distributor is releasably secured in the second axial end portion of the casing by an interference fit between the outer portion and the seat, further wherein the center portion defines a cavity adapted to house the nut such that the nut can move freely within the cavity.

2. The centrifugal compressor of claim 1, wherein the blades of the impeller are located within the intermediate portion of the casing.

3. The centrifugal compressor of claim 1, wherein the fixed blades of the distributor define a plurality of channels adapted to direct a fluid flow entering the compressor in a predetermined direction with respect to the substantially radially-oriented blades of the impeller.

4. The centrifugal compressor of claim 1, wherein the cylindrical seat defines a first length along its axis, and the ring-shaped outer portion of the distributor defines a second length along its axis that is substantially equal to the first length.

5. The centrifugal compressor of claim 1, wherein the annular shoulder defines a first inner diameter and the ring-shaped outer portion defines a second inner diameter that is substantially equal to the first inner diameter, thereby providing a flush interface between the intermediate portion and the ring-shaped outer portion proximate the annular shoulder.

6. The centrifugal compressor of claim 1, wherein the centrifugal compressor is adapted for supplying pressurized fluid to an automotive fuel cell system.

* * * * *